US005214938A

United States Patent [19]

Kennedy et al.

[11] Patent Number: 5,214,938

[45] Date of Patent: Jun. 1, 1993

[54] SPINE FIN REFRIGERATOR EVAPORATOR HAVING GENERALLY OVAL SPIRAL CONFIGURATION

[75] Inventors: Adam C. Kennedy; Thomas M. Benton; Bruce L. Ruark; John K. Besore, all of Louisville, Ky.; Jerry C. Martin, Corydon, Ind.; Martin M. Zentner, Louisville, Ky.

[73] Assignee: General Electric Company, Louisville, Ky.

[21] Appl. No.: 818,154

[22] Filed: Jan. 8, 1992

[51] Int. Cl.[5] ..... F25B 39/02

[52] U.S. Cl. ..... 62/515; 165/146; 165/172; 165/903

[58] Field of Search ..... 62/515; 165/172, 146, 165/903

[56] References Cited

U.S. PATENT DOCUMENTS

| | | | |
|---|---|---|---|
| 3,678,698 | 7/1972 | Gelbard et al. | 62/276 |
| 4,073,045 | 2/1978 | Margen et al. | 29/157 |
| 4,362,028 | 12/1982 | Armstrong | 62/521 |
| 5,067,322 | 11/1991 | Beers | 62/515 |

*Primary Examiner*—Ronald C. Capossela
*Attorney, Agent, or Firm*—Radford M. Reams; H. Neil Houser

[57] ABSTRACT

A side by side refrigerator has a vertical evaporator formed from an elongated tube wrapped with a ribbon of material having spine fins extending substantially perpendicular from the elongated tube. The elongated tube has elongated straight runs joined by return bent ends to define a vertically extending evaporator having a generally oval spiral or configuration. In one embodiment, the elongated straight runs are spaced from each other throughout the vertical length of the evaporator to provide a space of constant area for air flow. In other embodiments, the lower end of the evaporator has the elongated straight runs spaced from each other to provide an entrance passage for air with the remainder of the evaporator having some of the elongated straight runs at predetermined locations on at least one side of the evaporator offset inwardly towards the other side of the evaporator so that the fins on the offset elongated straight runs overlap the fins on the elongated straight runs on the other side of the evaporator to enhance "mixing" of the air flow around the various runs of the evaporator. The evaporator may have one of the elongated straight runs on one side of the evaporator moved into vertical alignment with adjacent elongated straight runs on the other side of the evaporator to which they are connected to provide a space intermediate the length of the evaporator for a defrost heater.

20 Claims, 3 Drawing Sheets

SPINE FIN REFRIGERATOR EVAPORATOR HAVING GENERALLY OVAL SPIRAL CONFIGURATION

FIELD OF THE INVENTION

This invention relates to a spine fin refrigerator evaporator and, more particularly, to a spine fin refrigerator evaporator having a generally oval spiral or race track configuration.

BACKGROUND OF THE INVENTION

U.S Pat. No. 5,067,322, issued to David G. Beers for "Refrigerator With Spine Fin Evaporator", and assigned to the same assignee as the assignee of this application, discloses a spine fin evaporator for a refrigerator. The spine fins of the evaporator of the aforesaid Beers patent, which is incorporated by reference herein, provide a large heat exchange area per unit length of the evaporator conduit or tube. This increase in the heat exchange area per unit length of the evaporator tube enables the size of the evaporator to be reduced for a given size refrigerator, which increases the usable storage space of the refrigerator.

The air being refrigerated by the evaporator is laden with moisture, and the evaporator normally operates at frost collecting temperatures. This moisture laden air flows around the fins and frost tends to build up quickly at the inlet end of the spine fin evaporator. This build up of frost requires the evaporator to be defrosted fairly often, which reduces the overall operating efficiency of the refrigerator.

The spine fin evaporator of the present invention satisfactorily solves the frost build up problem through disposing the evaporator in a substantially vertical orientation with a generally oval spiral or race track configuration. The evaporator is formed in the race track configuration by having an elongated tube formed with elongated straight runs or sides and relatively large radius return bent ends. This provides a relatively large space between the elongated straight runs through which the air can flow to enhance the air flow. This results in greater heat exchange values between the air and the elongated straight runs of the evaporator and reduces the pressure drop of the air due to frost build-up.

Additionally, the relatively large radius of the return bent ends result in a lower pressure drop of the refrigerant in the evaporator in comparison with a serpentine evaporator. This is because the relatively large return bent ends change the direction of the refrigerant gas more gradually.

The preferred embodiments are vertical spirals of evaporator tubing, rather than the horizontal spiral configurations of some current evaporators. Such horizontal coiled evaporators are subject to "puddling" of liquid refrigerant which causes "liquid slugging" and greater pressure drop of the refrigerant.

Some embodiments of the spine fin evaporator of the present invention have elongated straight runs on at least one side of the evaporator offset or deflected inwardly towards elongated straight runs on the other side of the evaporator. In some embodiments, these offset or deflected elongated straight runs are staggered throughout the vertical length of the evaporator except for the lower end of the evaporator over which the air flows initially. In some embodiments, this bottom portion is open to provide enhanced frost tolerance. The deflection or offset of the elongated straight runs is staggered vertically so that there are portions of the vertical length of the evaporator in which the elongated straight runs are spaced from each other for varying distances.

Both sides of the evaporator may have elongated straight runs offset or deflected inwardly towards the elongated straight runs on the other side of the evaporator. Preferably, this offsetting occurs at staggered intervals from one side of the evaporator to the other so that the elongated straight run on only one of the two sides of the evaporator at any specific location is moved inwardly towards the other side of the evaporator.

It is well known to position a defrost heater adjacent the end of a refrigerator evaporator first exposed to moisture laden air and, in some situations, to place such a heater intermediate the ends of the evaporator. If desired, such defrost heaters may be used in conjunction with evaporators incorporating the present invention.

SUMMARY OF THE INVENTION

A refrigerant evaporator, which is disposed within an evaporator chamber of a refrigerator through which air is caused to flow, is formed by an elongated tube having elongated straight runs joined by return bent ends to form the elongated tube in a generally oval spiral or race track configuration. Heat exchange spine fins are spaced at least along each of the elongated straight runs and project outwardly therefrom. The elongated straight runs, which form the sides of the evaporator, are generally spaced further apart than the combined distance that the fins project outwardly from adjacent elongated straight runs for at least a predetermined distance from the end of the evaporator first exposed to the flow of air. The straight runs forming the sides of the evaporator are substantially perpendicular to the direction of air flow through the evaporator chamber.

An object of this invention is to provide a spine fin refrigerant evaporator for a refrigerator having a race track or generally oval spiral configuration.

Another object of this invention is to provide a spine fin refrigerant evaporator for a refrigerator having a unique air flow arrangement through the length of the refrigerant evaporator.

Other objects of this invention will be readily perceived from the following description, claims, and drawings.

BRIEF DESCRIPTION OF THE DRAWINGS

The attached drawings illustrate preferred embodiments of the invention, in which.

DESCRIPTION OF THE PREFERRED EMBODIMENTS

Figure 1:
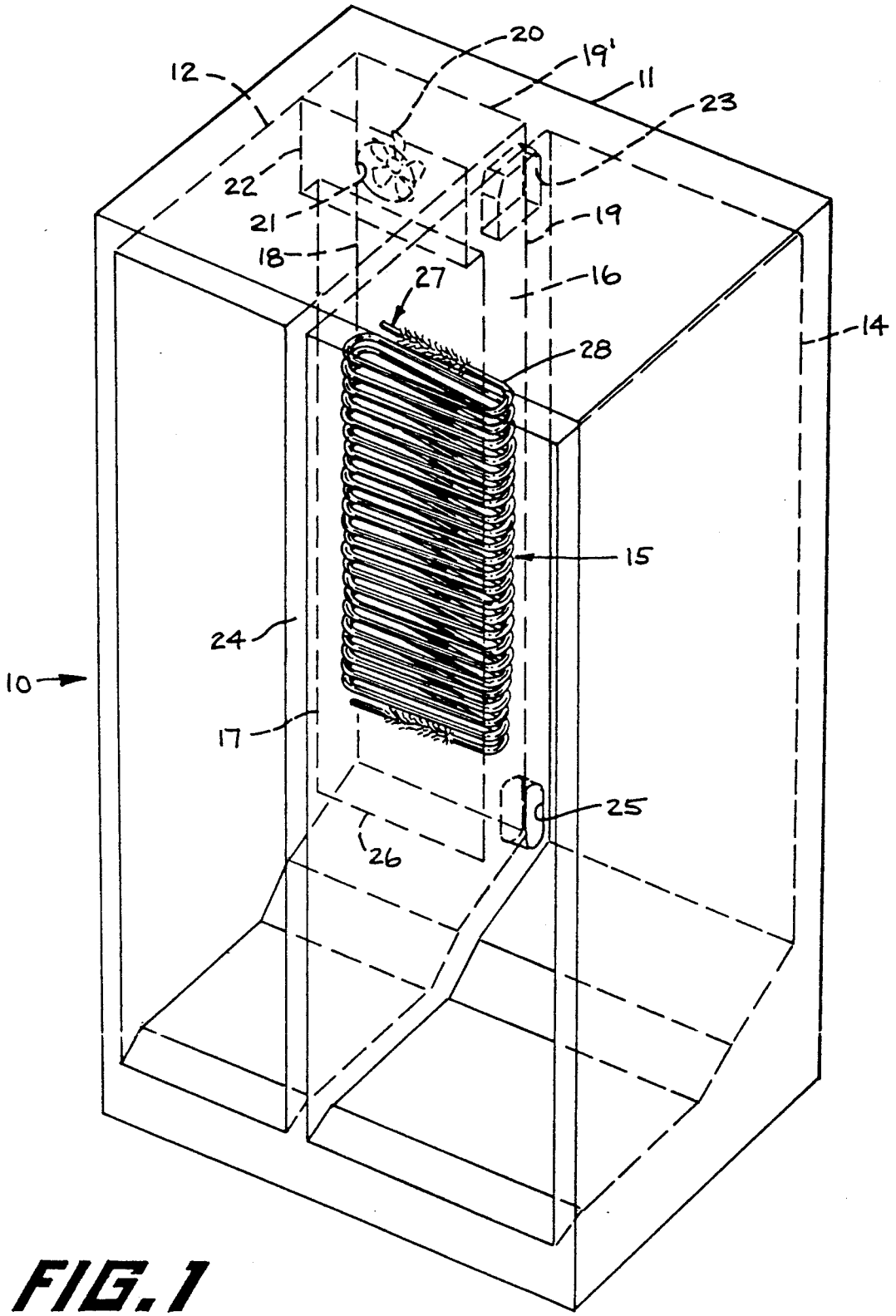
FIG. 1 is a schematic, simplified perspective view of a side by side refrigerator having a spine fin evaporator incorporating on form of the present invention with the doors removed.

Referring to the drawings and particularly FIG. 1, there is shown a side by side refrigerator 10 including an outer cabinet 11 containing a freezer compartment 12 and a fresh food compartment 14 arranged in a side by side relation. The freezer compartment 12 is maintained at below freezing temperatures and the fresh food compartment 14 is maintained at above freezing-food preserving temperatures by circulating air over a spine fin evaporator 15.

The evaporator 15 is disposed within a vertically extending evaporator chamber 16. The evaporator chamber 16 is formed by a vertically extending front wall 17, vertically extending side walls 18 and 19, and an inner rear liner 19′ of the refrigerator 10.

A motor driven fan 20 is positioned in the upper portion of the evaporator chamber 16 and discharges cooling air through an opening 21 in an upper offset portion 22 of the front wall 17 into the freezer compartment 12. The fan 20 also discharges cooling air through an opening 23 in a dividing wall 24, which separates the freezer compartment 12 and the fresh food compartment 14, into the fresh food compartment 14.

The fan 20 draws air from the fresh food compartment 14 through an opening 25 in the dividing wall 24 into the lower portion of the evaporator chamber 16. The fan 20 also draws air from the freezer compartment 12 through an opening 26 in the bottom of the front wall 17 of the evaporator chamber 16. Thus, the return air flows upwardly through the evaporator 15 from its lower end and substantially perpendicular to the portions of the evaporator tube forming the sides of the evaporator 15.

The cooling air supplied from the fan 20 through the openings 21 and 23 is divided so that the freezer compartment 12 is maintained at below freezing temperatures and the fresh food compartment 14 is maintained at above freezing temperatures but at food preserving temperatures. This division of the cooling air is well known in the art. Various well-known components of a refrigerator such as, for example, shelves, controls, motors and so forth, have been omitted for the sake of simplicity.

The evaporator 15 is an elongated tube 27 (see FIG. 2) formed by elongated straight runs 28 having return bent ends 29 connected to each end of each of the elongated straight runs 28. Each of the elongated straight runs 28 and each of the return bent ends 29 has spine fins 30 extending substantially perpendicular therefrom. To form the evaporator 15, a ribbon of material having the spine fins 30 is wrapped around a section of the evaporator tube 27 at least long enough to form the evaporator 15. Then the tube 27 is bent or formed into the desired configuration.

For ease in illustrating the configurations of the illustrative evaporators, the material of the spine fin 30 has been schematically illustrated extended along only small portions of, the evaporator tube 27. In addition, in FIGS. 3, 5, 6 and 7, the material of the spine fin 30 is represented by a dashed circle spaced around the outside of the tube 27 for most of the fins 30 and no spine fin material is shown at the return bent end portions to better illustrate their configurations. It will be understood that, in the preferred embodiment, a strip of spine fin material is continuously wrapped around the entire length of the evaporator tube 27 (see FIG. 2).

The sequentially adjacent elongated straight runs 28, which form the evaporator 15, are positioned on opposite sides of the evaporator 15. For example, the inlet end of a straight run 28 in the front of the evaporator 15 is connected to the preceding straight run 28 on the back of the evaporator 15 by a return bent end connected to the subsequent back side straight run 28 and return bent ends 29 to form an oval spiral. As can be seen in FIG. 1, the spiral continuously climbs from the bottom to the top of the evaporator chamber 16.

The fins 30 (see FIG. 2) on each of the return bent ends 29 tend to be compressed or bent over as a result of the equipment used to bend the tube.

Figure 2:
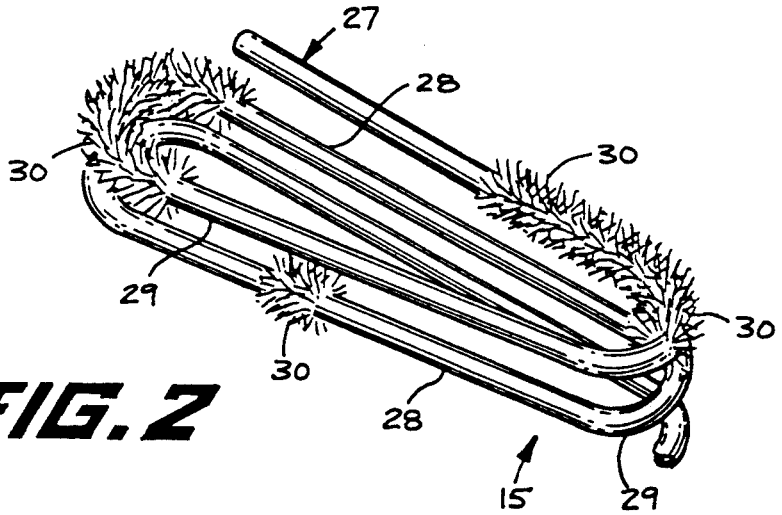
FIG. 2 is a perspective view of a portion of one embodiment of the spine fin evaporator of the present invention and showing two successive elongated straight runs and associated return bent ends.

The evaporator 15 has a generally oval spiral or race track configuration when viewed from above as shown in FIG. 2. Each of the elongated straight runs 28 is slightly higher than the previous elongated straight run 28 to which it is connected and each of the elongated straight runs 28 is angled slightly upward to the horizontal. The presently preferred operation of the evaporator 15 is to feed refrigerant in at the lower end and exhaust refrigerant from the top of the evaporator 15, in order to take advantage of the temperature drop that occurs as the pressure decreases due to gravitational and flow losses. With that operation a the refrigerant continually rises through the oval spiral. When a refrigerant system is turned off for a length of time, some of the refrigerant gas in the evaporator may condense into a liquid. With any of the illustrative evaporator structures, such liquid refrigerant will flow to the bottom of the evaporator, minimizing the possibility of liquid refrigerant exiting the evaporator when the system restarts.

The space between inner surfaces of sequentially adjacent elongated straight runs 28 on opposite sides of the evaporator 15 is over twice the distance that the fins 30 extend outwardly from each of the elongated straight runs 28. This means that the fins do not overlap and preferably the spacing is large enough to provide a relatively large channel area through which air can be drawn through the interior of the evaporator 15 by the fan 20 (see FIG. 1).

Figure 3:
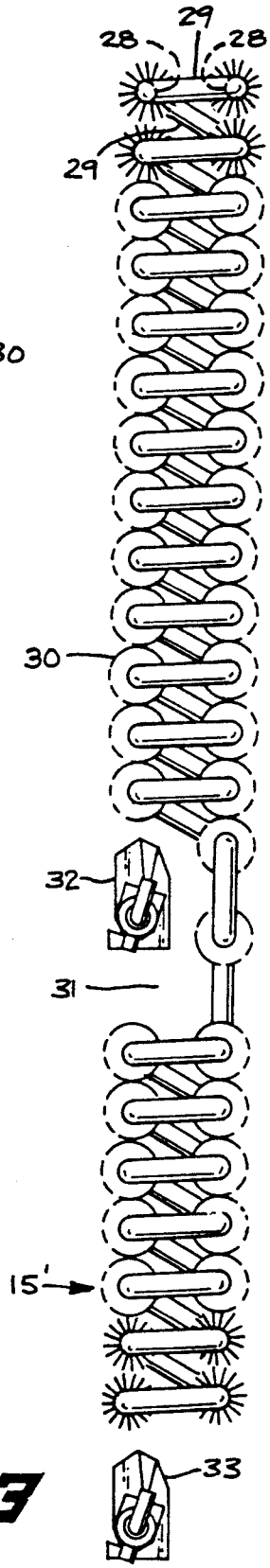
FIG. 3 is an end elevational view of the spine fin evaporator having the race track configuration of FIG. 2 and showing the elongated straight runs arranged for a defrost heater to be disposed intermediate the ends of the evaporator.

The evaporator 15' in FIG. 3 is an evaporator the same the evaporator as 15 in FIG. 1, which has undergone an additional manufacturing step to accommodate a defrost heater.

As shown in FIG. 3, a portion of the left side of the evaporator 15' does not have the elongated straight runs 28 extending therealong. This provides a space 31 intermediate the ends of the evaporator 15' for a defrost heater 32. One suitable example of the defrost heater 32 is the defrost heater shown and described in U.S. Pat. No. 5,042,267 to Beers et al. A second defrost heater 33, which may be the same as the defrost heater 32, is positioned beneath the bottom of the evaporator 15'.

The space 31 is formed in the evaporator 15' by moving a first of the elongated straight runs 28 from the left side of the evaporator 15 to between the two sequentially adjacent elongated straight runs 28 on the right side of the evaporator 15'. As viewed in FIG. 3, this is accomplished by rotating the return bent end 29 below the left side run 28, which is inclined slightly from right to left, slightly less than 90° clockwise and rotating the return bent end 29 above the left side straight run 28, which is inclined slightly from left to right, slightly less than 90° counterclockwise. This moves the straight run 28 from the left to the right side and makes the adjacent ends vertical.

Figure 5:
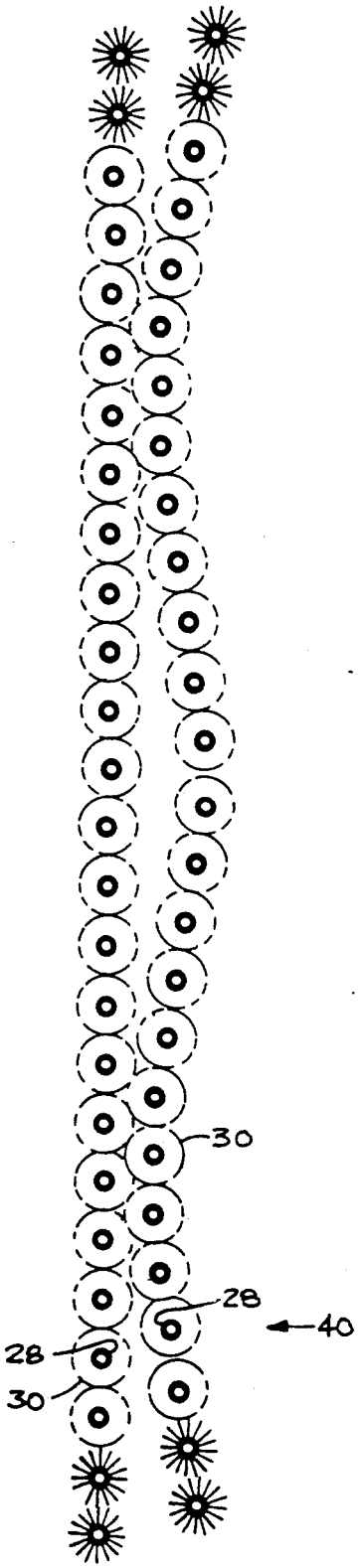
FIG. 5 is a simplified sectional view generally as taken along line 5—5 in FIG. 4 but illustrating the arrangement of elongated runs of another embodiment of the spine fin evaporator of the present invention in which the elongated straight runs on one side of the evaporator are gradually deflected or offset inwardly toward the corresponding elongated straight runs of the other side of the evaporator, in increasing and then in decreasing amounts until there is no deflection or offset from the lower end of the evaporator to the other in two stages to provide a varying distance in the space between the elongated straight runs.
Figure 6:
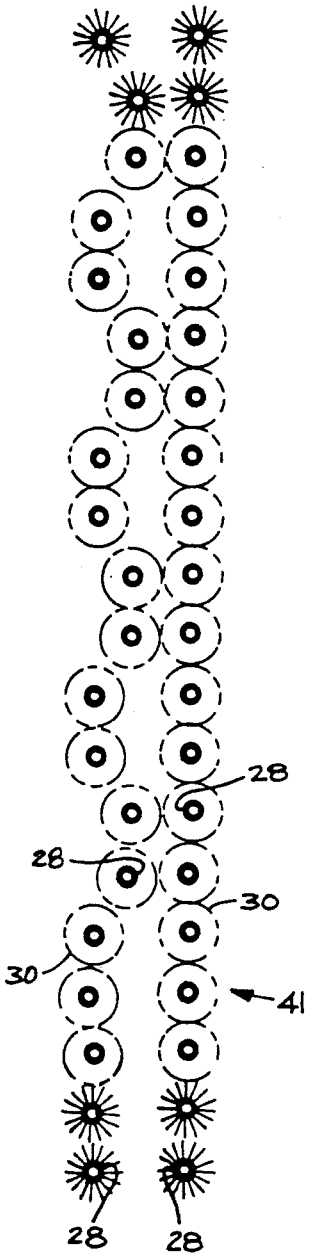
FIG. 6 is a simplified sectional view similar to FIG. 5 but illustrating the arrangement of the elongated runs of yet a further modification of the spine fin evaporator of the present invention in which selected elongated straight runs on one side of the evaporator are deflected or offset inwardly toward the elongated straight runs on the other side of the evaporator.

Instead of using the evaporator 15 (see FIG. 1) in the evaporator chamber 16 with the elongated straight runs 28 (see FIG. 2) spaced from each other substantially the same distance throughout, the ,. length of the evaporator 15 or the evaporator 15' (see FIG. 3) which provides the intermediate heater space 31, a spine fin evaporator 40 (see FIG. 5) may be employed. The evaporator 40 has the elongated straight runs 28 on its left side vertically aligned with each other throughout the length of the evaporator 40 while the right side of the evaporator 40 has the elongated straight runs 28 deflected gradually inwardly in increasing amounts to form an entering air passage at its lower end of decreasing size from its entrance until the fins 30 on two of the elongated straight runs 28 overlap each other as shown in FIG. 5. After the fins 30 on three pairs of the elongated straight runs 28 overlap each other a shown in FIG. 5, the elongated straight runs 28 on the right side of the evaporator 40 are gradually spaced further from the corresponding elongated straight runs 28 on the left side of the evaporator 40 until there is a maximum space between the elongated straight runs 28 because of no deflection as shown in FIG. 2 for the evaporator 15.

As shown in FIG. 5, the evaporator 40 has two sections of the gradual decreasing and increasing width passages formed between the elongated straight runs 28 on the left and right sides of the evaporator 40. The number of these gradual sections of decreasing and increasing spacing may be one or more than two if desired. The number of these gradual sections would depend upon the length of the evaporator 40 and the desired air flow.

A spine fin evaporator 41 (see FIG. 6) may be used in the evaporator chamber 16 (see FIG. 1) instead of the evaporator 15. The evaporator 41 (see FIG. 6) has five of the elongated straight runs 28 on the left side of the evaporator 41 vertically aligned and spaced from five of the elongated straight runs 28 on the right side of the evaporator 41. The next two of the elongated straight runs 28 on the left side of the evaporator 41 are deflected or offset toward two of the elongated straight runs 28 on the right side of the evaporator 41 so that the fins 30 overlap in the same relationship as shown in FIG. 5 for two of the elongated straight runs 28 of the evaporator 40. Thus, the evaporator 41 (see FIG. 6) has an entrance passage at its lower end of a constant spacing between the elongated straight runs 28 extending for a predetermined distance; the spacing between the elongated straight runs 28 of the evaporator 41 is the relation of the two elongated straight runs 28 shown in FIG. 2.

After the first two of the elongated straight runs 28 (see FIG. 6) on the left side of the evaporator 41 are deflected or offset inwardly toward two of the elongated straight runs 28 on the right side of the evaporator 41, the next two of the elongated straight runs 28 on the left side of the evaporator 41 are spaced the maximum distance from the corresponding elongated straight runs 28 on the right side of the evaporator 41 in the same manner as shown for the evaporator 15 in FIG. 2. This spacing forms the same size air passage as the entrance passage at the lower end of the evaporator 41 (see FIG. 6).

The inward deflection or offset of two of the elongated straight runs 28 on the left side of the evaporator 41 toward two of the elongated straight runs 28 on the right side of the evaporator 41 and the spacing of the next two of the elongated straight runs on the left side of the evaporator 41 from the elongated straight runs 28 on the right side of the evaporator 41 are continued to the top of the evaporator 41.

Therefore, the evaporator 41 has an entrance passage extending from its lower end for a predetermined distance of a substantially constant area by having the maximum spacing between the elongated straight runs 28 on opposite sides of the evaporator 41. This area is sufficiently large to accommodate build up of the frost between the elongated straight runs 28 and the fins 30 thereon. Accordingly, air can flow through the entrance passage, which builds up with frost most rapidly because of the moisture laden air contacting for a longer period of time than would occur when one of the elongated straight runs 28 on the left side of the evaporator 41 is deflected or offset inwardly until the fins 30 thereon overlap the fins 30 on one of the elongated straight runs 28 on the right side of the evaporator 41.

Figure 4:
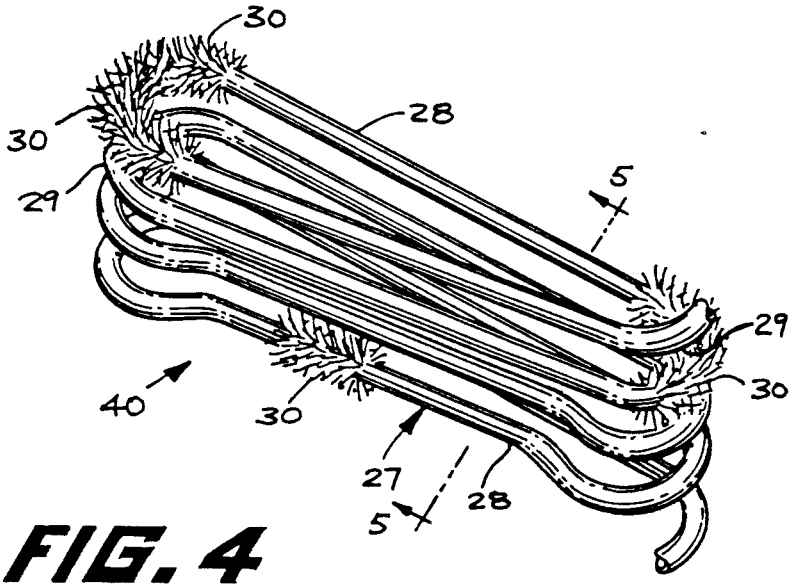
FIG. 4 is a perspective view of a portion of a spine fin evaporator of the present invention in which one of two elongated straight runs connected to each other is deflected or offset inwardly toward the other of the two elongated straight runs.

However, with the elongated straight runs 28 of the evaporator 41 spaced from each other as shown in FIG. 2 for the evaporator 15, the amount of heat transfer to the air from the refrigerant for cooling purposes is substantially lower in the open space than where the fins 30 on the elongated straight runs 28 overlap as shown in FIG. 4.

By alternately forming air passages of relatively large size between portions of the evaporator 41 (see FIG. 6) having the fins 30 overlapping, there is an efficient heat exchange to cool the air while the frost build up primarily occurs in the relatively large size passages. This extends the time for the frost build up before defrosting is required while still having an efficient heat transfer to the refrigerant in the evaporator 41 from the air flow in the overall construction of the evaporator 41.

It will be understood that the construction shown in FIG. 5 may be varied to best suit a particular refrigerator design. For example, the lower open section may be longer or shorter, the number of the elongated straight runs 28 indented inwardly in any particular section may vary from the two shown, the number of indented sections may vary and the elongated straight runs 28 may be indented from the right rather than the left.

Figure 7:
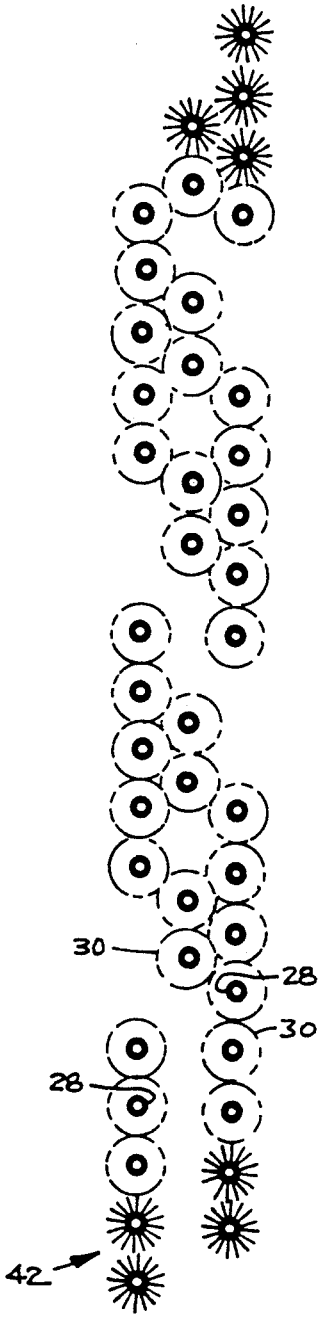
FIG. 7 is a simplified sectional view similar to FIG. 5 but illustrating the arrangement of the elongated runs of still another embodiment of the spine fin evaporator of the present invention in which selected elongated straight runs on each side of the evaporator are deflected or offset inwardly towards elongated straight runs on the other side of the evaporator in staggered relation with portions between the deflected or offset elongated straight runs having no deflection or offset of the elongated straight runs on either side of the evaporator.

As shown in FIG. 7, an evaporator 42 has an entrance passage at its lower end formed with a maximum space between the 0 elongated straight runs 28 on the right and left sides respectively, in the same manner as shown in FIG. 2 for the elongated straight runs 28 of the evaporator 15. After the entrance passage with the maximum area extends for a predetermined distance from the lower end of the evaporator 42, two of the elongated straight runs 28 on the left side of the evaporator 42 are deflected or offset inwardly towards the elongated straight runs 28 on the right side of the evaporator 42 in the same manner as shown for the evaporator 40 in FIG. 4. Thus, the fins 30 (see FIG. 7) overlap in the manner shown for the evaporator 40 in FIG. 4.

After two of the elongated straight runs 28 o the left side of the evaporator 42 (see FIG. 7) have been deflected or offset inwardly towards the elongated straight runs 28 on the right side of the evaporator 42, there is at least one of the elongated straight runs 28 on each side of the evaporator 42 spaced the maximum from each other by having no deflection of either of the elongated straight runs 28 to form the maximum air passage therebetween.

Next, two of the elongated straight runs 28 on the right side of the evaporator 42 of the carrier are deflected or offset inwardly towards two of the elongated straight runs 28 on the left side of the evaporator 42. The fins 30 of these elongated straight runs 28 overlap in the manner shown for the evaporator 40 in FIG. 4. This arrangement of deflecting the elongated straight runs 28 on one side of the evaporator 42 (see FIG. 7) and then on the other side of the evaporator 42 with a maximum space between at least one of the elongated straight runs 28 on each side of the evaporator 42 therebetween continues throughout the vertical length of the evaporator 42.

While the evaporators 15 (see FIG. 1), 15' (see FIG. 3), 40 (see FIG. 5), 41 (see FIG. 6), and 42 (see FIG. 7) of the present invention have been shown and described for use in a side by side refrigerator 10 (see FIG. 1), it should be understood that the present invention may be incorporated in evaporators sized for use with a refrigerator having the freezing and fresh food compartments vertically stacked with respect to each other.

While the return bent ends 29 (see FIG. 2) have been shown and described as having the fins 30 thereon, it should be understood that the fins 30 could be omitted from the return bent ends 29. However, such an evaporator would not be as efficient as the fins 30 on the bent ends 29 provide some additional heat exchange action even though they have become somewhat compacted.

It also should be understood that each of the evaporators 40 (see FIG. 5), 41 (see FIG. 6), and 42 (see FIG. 7) normally would have at least the defrost heater 33 (see FIG. 3) beneath its bottom end. It is not believed that any of the evaporators 40 (see FIG. 5), 41 (see FIG. 6), and 42 (see FIG. 7) would normally require the intermediate frost heater 32 (see FIG. 3) as is used with the evaporator 15'. However, such a heater can be provided if desired.

An advantage of this invention is that optimum air flow is obtained over the evaporator. Another advantage of this invention is that the relatively large radius of curvature of each of the return bent ends of the evaporator produces a lower internal pressure drop of the refrigerant than occurs with a serpentine evaporator. A further advantage of this invention is that more effective heat exchange is obtained between the air and the refrigerant in the evaporator. Still another advantage of this invention is that it maintains required air flow as frost builds up on the evaporator.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A refrigerator having:
an evaporator chamber;
means for causing air to flow through said evaporator chamber in a predetermined direction;
a refrigerant evaporator disposed within said evaporator chamber;
said refrigerant evaporator including:
an elongated tube having elongated straight runs joined by return bent ends to form said elongated tube in a generally oval spiral configuration, said elongated straight runs forming opposite sides of said refrigerant evaporator;
said elongated tube having a plurality of heat exchange fins spaced along at least each of said elongated straight runs, said fins projecting outwardly from said elongated tube;
and said elongated straight runs forming said opposite sides of said refrigerant evaporator being spaced apart further than twice the distance that said fins project outwardly from each of said elongated straight runs for at least a predetermined distance from the end of said refrigerant evaporator first exposed to the flow of air;
and said elongated straight runs of said refrigerant evaporator extending substantially perpendicular to the direction of air flow through said evaporator chamber.

2. The refrigerator according to claim 1 in which said opposite sides of said refrigerant evaporator have a varying space therebetween along the length of said refrigerant evaporator with said space being wider at the end of said refrigerant evaporator first exposed to the flow of air than further along the length of said refrigerant evaporator.

3. The refrigerator according to claim 2 in which said space between said opposite sides of said refrigerant evaporator continuously decreases for a predetermined distance from the end of said refrigerant evaporator first exposed to the flow of air until said fins on at least one of said elongated straight runs on each of said opposite sides of said refrigerant evaporator overlap.

4. The refrigerator according to claim 3 in which said space between said opposite sides of said refrigerant evaporator continuously increases for a predetermined distance after said fins on at least one of said elongated straight runs on each of said opposite sides of said refrigerant evaporator initially overlap.

5. The refrigerator according to claim 2 in which said space between said opposite sides of said refrigerant evaporator is substantially constant for a predetermined distance from the end of said refrigerant evaporator first exposed to the flow of air.

6. The refrigerator according to claim 1 in which each of a predetermined number of said elongated straight runs of said elongated tube on at least one of said opposite sides of said refrigerant evaporator is offset inwardly toward the other of said opposite sides of said refrigerant evaporator.

7. The refrigerator according to claim 6 in which each of said predetermined number of said elongated straight runs of said elongated tube on at least said one side of said refrigerant evaporator is offset inwardly toward said other side of said refrigerant evaporator sufficiently that said fins on each of said predetermined number of said elongated straight runs and said fins on at least one of said elongated straight runs on said other side of said refrigerant evaporator overlap.

8. The refrigerator according to claim 1 in which each of a predetermined number of said elongated straight runs of said elongated tube on each of said opposite sides of said refrigerant evaporator is offset inwardly toward the other of said opposite sides of said refrigerant evaporator sufficiently that said fins of each on said predetermined number of said elongated straight runs and said fins on at least one of said elongated straight runs on said other side of s id refrigerant evaporator overlap.

9. The refrigerator according to claim 8 in which each of said predetermined number of said elongated straight runs of said elongated tube on one of said opposite sides of said refrigerant evaporator is staggered relative to each of said predetermined number of said elongated straight runs of said elongated tube on said other side of said refrigerant evaporator.

10. The refrigerator according to claim 1 in which said elongated straight runs forming said opposite sides of said refrigerant evaporator are spaced apart further than the distance that said fins project outwardly from each of said elongated straight runs for the length of said refrigerant evaporator.

11. The refrigerator according to claim 10 including:

space forming means for forming a space in said refrigerant evaporator intermediate its ends;

and defrost heating means disposed in said space in said refrigerant evaporator intermediate its ends to aid in defrosting said refrigerant evaporator.

12. A refrigerator having:

substantially vertically extending walls defining an evaporator chamber;

fan means for causing air to flow generally upwardly through said evaporator chamber;

a refrigerant evaporator disposed within said evaporator chamber;

said refrigerant evaporator including:

an elongated tube having elongated straight runs joined by return bent ends to form said elongated tube in a generally oval spiral configuration, said elongated straight runs forming opposite sides of said refrigerant evaporator, and each of elongated straight runs extending substantially horizontal;

said elongated tube having a plurality of heat exchange fins spaced along at least each of said elongated straight runs, said fins projecting outwardly from said elongated tube;

and said elongated straight runs forming said opposite sides of said refrigerant evaporator being generally spaced apart more than twice the distance that said fins project outwardly from said elongated straight runs for at least a predetermined distance from the lower end of said refrigerant evaporator;

and said sides of said refrigerant evaporator extending substantially vertical and lying closely adjacent to corresponding ones of said vertically extending walls.

13. The refrigerator according to claim 12 in which said opposite sides of said refrigerant evaporator have a varying space therebetween along the vertical length of said refrigerant evaporator with said space being wider at the lower end of said refrigerant evaporator than further along the vertical length of said refrigerant evaporator.

14. The refrigerator according to claim 13 in which said space between said opposite sides of said refrigerant evaporator continuously decreases for a predetermined distance from the lower end of said refrigerant evaporator until said fins on at least one of said elongated straight runs on each of said opposite sides of said refrigerant evaporator overlap.

15. The refrigerator according to claim 14 in which said space between said opposite sides of said refrigerant evaporator continuously increases for a predetermined distance after said fins on at least one of said elongated straight runs on each of said opposite sides of said refrigerant evaporator initially overlap.

16. The refrigerator according to claim 13 in which said space between said opposite sides of said refrigerant evaporator is substantially constant for a predetermined distance from the lower end of said refrigerant evaporator.

17. The refrigerator according to claim 12 in which each of a predetermined number of said elongated straight runs of said elongated tube on at least one of said opposite sides of said refrigerant said refrigerant evaporator.

18. The refrigerator according to claim 17 in which each of said predetermined number of said elongated straight runs of said elongated tube on at least said one side of said refrigerant evaporator is offset inwardly toward said other side of said refrigerant evaporator sufficiently that said fins on each of said predetermined number of said elongated straight runs and said fins on at least one of said elongated straight runs on said other side of said refrigerant evaporator overlap.

19. The refrigerator according to claim 12 in which said elongated straight runs forming said opposite sides of said refrigerant evaporator are spaced apart more than twice the distance that said fins project outwardly from each of said elongated straight runs for the length of said refrigerant evaporator.

20. The refrigerator according to claim 19 including:

space forming means for forming a space in said refrigerant evaporator intermediate its ends;

and defrost heating means disposed in said space in said refrigerant evaporator intermediate its ends to aid in defrosting said refrigerant evaporator.

* * * * *